US006033778A

United States Patent [19]

Kakihara et al.

[11] Patent Number: 6,033,778

[45] Date of Patent: Mar. 7, 2000

[54] AROMATIC POLYAMIDE BRISTLE

[75] Inventors: Ryuichi Kakihara, Matsuyama; Takashi Noma, Osaki, both of Japan

[73] Assignee: Teijin Limited, Osaka, Japan

[21] Appl. No.: 08/983,138

[22] PCT Filed: May 20, 1997

[86] PCT No.: PCT/JP97/01688

§ 371 Date: Jan. 21, 1998

§ 102(e) Date: Jan. 21, 1998

[87] PCT Pub. No.: WO97/44510

PCT Pub. Date: Nov. 27, 1997

[51] Int. Cl.[7] ..... D02G 3/00

[52] U.S. Cl. ..... 428/364; 428/395

[58] Field of Search ..... 428/364, 395, 428/397

[56] References Cited

U.S. PATENT DOCUMENTS

| | | | |
|---|---|---|---|
| 4,075,172 | 2/1978 | Ozawa et al. | 260/47 CZ |
| 5,246,776 | 9/1993 | Meraldi et al. | 428/364 |
| 5,378,538 | 1/1995 | Makino et al. | 428/364 |

FOREIGN PATENT DOCUMENTS

| | | |
|---|---|---|
| 51-076386 | 7/1976 | Japan . |
| 59-144610 | 8/1984 | Japan . |
| 4500394 | 1/1992 | Japan . |
| 51-63610 | 6/1993 | Japan . |

*Primary Examiner*—Newton Edwards
*Attorney, Agent, or Firm*—Foley & Lardner

[57] ABSTRACT

The present invention provides an aromatic polyamide bristle exhibiting excellent chemical resistance to acid, alkali, etc., and good mechanical properties such as rigidity, strength and modulus and heat-resistance, suitable for industrial applications such as tension member, fishing line and catheter, having a single fiber fineness of 10 to 200 denier, a flatness of 3 or below and mechanical properties characterized by a tensile strength of 15 g/de or above, an elongation at break of 4.0% or below and an initial modulus of 500 g/de or above and formed from an optically isotropic solution.

2 Claims, No Drawings

AROMATIC POLYAMIDE BRISTLE

DETAILED DESCRIPTION OF THE INVENTION

1. Technical Field

The present invention relates to an aromatic polyamide bristle, more particularly to an aromatic polyamide bristle having light weight and high strength and modulus as well as excellent chemical resistance and widely usable in various industrial fields such as tension member, fishing line and catheter.

2. Background Art

Nylon bristle and polyester bristle have been used widely as a polishing brush and fishing line owing to the high rigidity and abrasion resistance. A meta-type aromatic polyamide bristle is also in use as a polishing brush severely required to have high heat-resistance and abrasion resistance. However, these bristles have insufficient mechanical properties such as strength and modulus.

In contrast with the above, a para-type aromatic polyamide bristle has excellent mechanical properties represented by high strength, modulus and rigidity and, accordingly, the application field of the bristle is expected to be developable to industrial materials and leisure uses for the reinforcement of a rubber article such as tire or a plastic article. The conventional para-type aromatic polyamide bristle is, however, a poly-p-phenylene terephthal-amide bristle produced by the wet-spinning of an optically anisotropic solution (Japanese Patent TOKUHYOUHEI 4-500394) and has a problem of poor chemical resistance to acids and alkalis in spite of excellent rigidity, mechanical properties, heat-resistance, etc.

A thick-denier fiber made of a para-type aromatic polyamide is disclosed in Japanese Patent TOKKAIHEI 5-163610. The object of the invention is to improve the twist strength utilization factor for developing the application to industrial fields such as rope, hose and belt using a cord having high twist number by flattening the cross-section of the fiber to lower the geometrical moment of inertia and facilitate the twisting deformation in the twisting process. Accordingly, the thick-denier fiber having a single fiber fineness of 10 de or over disclosed in the invention is limited to those having extremely high flatness. Since the fiber has insufficient rigidity and is easily deformable by external force, such fiber can never be called as a bristle.

DISCLOSURE OF INVENTION

The object of the present invention is to provide a para-type aromatic polyamide bristle having excellent mechanical properties represented by high rigidity, strength and modulus and good heat-resistance and chemical resistance.

As a result of extensive investigation for achieving the above object, the inventors of the present invention have found that a fiber (especially represented by copoly-p-phenylene 3,4'-oxydiphenylene terephthalamide fiber) produced by the wet-spinning of an optically isotropic solution is needed to be drawn at high draw ratio after spinning, therefore, the extremely large -single fiber fineness of an undrawn fiber is necessary for getting a bristle having a single fiber fineness of 10 de or over and, as a result, the production of a bristle, having excellent mechanical properties such as strength and modulus, becomes difficult owing to the insufficient or non-homogeneous desolvation in spinning. On the contrary, the desolvation rate can be increased without generating defects in the fiber to enable homogeneous coagulation of even a bristle having large single fiber fineness and obtain an aromatic polyamide bristle having excellent chemical resistance by increasing the dope temperature and the coagulation bath temperature and lowering the concentration of the good solvent in the coagulation bath.

The aromatic polyamide bristle of the present invention achieving the above object is produced from an optically isotropic solution and has a single fiber fineness of 10 to 200 de, a flatness of 3 or less and mechanical properties characterized by a tensile strength of 15 g/de or above, an elongation at break of 4.0% or less and an initial modulus of 500 g/de or above.

BEST MODE FOR CARRYING OUT THE INVENTION

The aromatic polyamide constituting the bristle of the present invention is an aromatic polyamide or an aromatic copolyamide composed of the recurring units expressed by the following formulas and accounting for not less than 80 mol %, preferably not less than 90 mol % of the total recurring units and capable of forming an optically isotropic solution.

Recurring Unit $$—NH—Ar_1—NHCO—Ar_2—CO—$$

wherein $Ar_1$ and $Ar_2$ are each independently an aromatic group selected from the following groups:

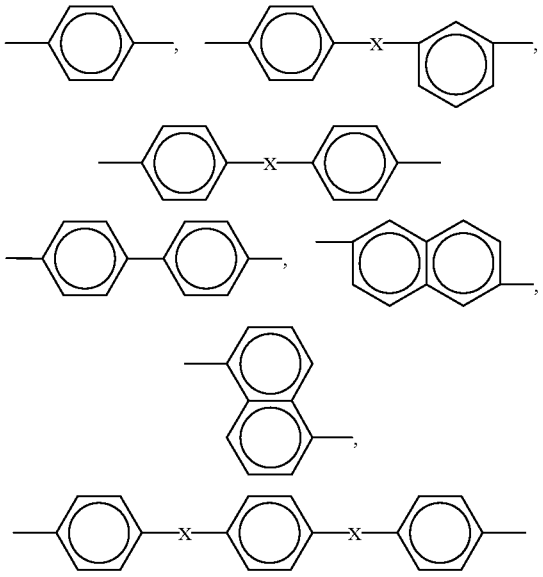

the hydrogen atom of the aromatic group may be substituted with a halogen atom or a lower alkyl group, and X is a group selected from the following bivalent groups:

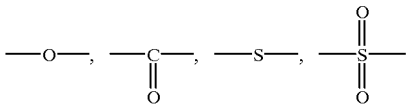

Especially preferable polyamide is a copolyamide containing 3,4'-oxydiphenylene terephthalamide accounting for 15 to 80 mol %, especially 20 to 60 mol % and p-phenylene terephthalamide accounting for 85 to 20 mol %, specially 80 to 40 mol % of the total recurring units to give a bristle having especially excellent resistance to acids and alkalis.

The processes for producing such aromatic polyamide are described e.g. in Japanese Patents TOKKAISHO 51-76386, TOKKAISHO 51-134743 and TOKKAISHO 51-136916. There is no particular restriction on the polymerization degree of the aromatic polyamide, however, the polymerization degree is higher the better within the range not to deteriorate the formability of the polymer provided that the polymer is soluble in a solvent to form an optically isotropic dope. The polymer may be incorporated with ultraviolet absorber, inorganic or organic pigment and other additives.

The bristle of the present invention is produced by dissolving the above aromatic polyamide in an organic solvent and subjecting the resultant optically isotropic dope to wet-spinning and drawing. A bristle produced from an optically anisotropic dope has too low chemical resistance to achieve the object of the present invention probably by the loss of the denseness of the fine structure of the fiber, although the detail of the reason is not clear. The dope may be an organic solvent dope produced by the solution polymerization or a dope produced by dissolving a separately prepared aromatic polyamide in an organic solvent provided that the dope contains a dissolved aromatic polyamide and exhibits optical isotropy.

A conventional aprotic organic polar solvent can be used as the polymerization solvent or an organic solvent for redissolution. Examples of the solvent are N-methyl-2-pyrrolidone, N-ethyl-2-pyrrolidone, N,N-dimethylformamide, N,N-dimethylacetamide, N,N-diethylacetamide, N,N-dimethylpropionamide, N,N-dimethylbutylamide, N,N-dimethylisobutylamide, N-methylcaprolactam, N,N-dimethylmethoxyacetamide, N-acetylpyrrolidine, N-acetylpiperidine, N-methylpiperidone-2, N,N'-dimethylethyleneurea, N,N-dimethylpropyleneurea, N,N,N',N'-tetramethylmalonamide, N-acetylpyrrolidone, N,N,N',N'-tetramethylurea and dimethyl sulfoxide.

A proper amount of an inorganic salt may be added as a dissolution assistant to improve the solubility of the polymer before, during or after the solution polymerization or in the case of dissolving a separately obtained aromatic polyamide in a solvent. Examples of the inorganic salt are lithium chloride and calcium chloride. In addition to the above examples, a quaternary ammonium salt such as methyl-tri-n-butylammonium chloride, methyl-tri-n-propylammonium chloride, tetra-n-propylammonium chloride or tetra-n-butylammonium chloride may be used as the dissolution assistant.

The bristle of the present invention produced by the wet-spinning of an isotropic dope of the above aromatic polyamide is required to have the fiber cross-section flatness of 3 or below, preferably 2 or below, especially 1.5 or below. The term "flatness" is the ratio (a/b) of the major axis (a) to the minor axis (b) perpendicularly crossing with each other on a cross-section perpendicular to the fiber axis. The fiber cross-section may have an irregular contour as well as a smooth contour. The geometrical moment of inertia of a bristle is decreased when the flatness of the fiber exceeds 3 and, accordingly, the deformation resistance of the bristle is lowered and the rigidity becomes poor for the use as a bristle.

The single fiber fineness of the bristle of the present invention is required to fall within the range of 10 to 200 denier, preferably 20 to 100 denier. When the single fiber fineness is smaller than 10 denier, the rigidity becomes too low to satisfy the shape-retaining property required as a bristle. On the other hand, a bristle thicker than 200 denier is liable to lose the homogeneity owing to the lowering of the coagulation property in wet-spinning and, as a result, the condition of the drawing process is deteriorated and the mechanical properties of the obtained bristle are lowered to undesirable levels.

The tensile strength of the bristle of the present invention is 15 g/de or above, preferably 20 to 30 g/de. The tensile strength is higher the better, however, the strength is generally lowered by the increase in the single fiber fineness of the bristle and the bristle loses the characteristics of an aromatic polyamide bristle as a high-strength fiber when the tensile strength is lower than 15 g/de.

The breaking extension of the bristle of the present invention is 4.0% or less, preferably 2.5 to 3.5%. A bristle having a breaking elongation of larger than 4.0% causes a problem of excessive elongation in the case of using as a fishing line or a tension member.

The initial modulus of the bristle is 500 g/de or over, especially 600 to 1,000 g/de. The merits of a high-modulus fiber are lost at the initial modulus of smaller than 500 g/de.

The aromatic polyamide bristle of the present invention is produced by the wet-spinning and drawing of the aforementioned optically isotropic dope. The dope may be extruded into the coagulation bath directly or interposing an air gap. The latter process (semi-dry semi-wet wet-spinning: dry jet spinning) is preferable to get a bristle having excellent mechanical properties.

It is essential that the solvent of the aromatic polyamide dope is uniformly transferred into the coagulation bath to effect the uniform coagulation of the fiber in the above wet-spinning process for producing the bristle of the present invention having excellent mechanical properties in spite of large denier (large diameter). For satisfying the above requirement, in contrast to the traditional view that the control of coagulation speed is impossible even by changing the coagulation conditions, the coagulation speed is controlled in the present invention to prevent the formation of defects in the aromatic polyamide bristle by the selective combination of a dope concentration, a dope temperature, a coagulation bath temperature, a coagulation bath concentration (concentration of good solvent: coagulation speed is adjusted by adding a good solvent) and a dipping time in the coagulation bath. For example, the removal of solvent proceeds in desirable state and a uniformly coagulated undrawn fiber can be produced in the case of co-p-phenylene 3,4'-oxydiphenylene terephthal-amide by using a dope (N-methyl-2-pyrrolidone solution) having a concentration of 5 to 8% and a temperature of 80 to 120° C., preferably a concentration of 5.5 to 6.5% and a temperature of 100 to 120° C. and using a coagulation bath consisting of an aqueous solution of N-methyl-2-pyrrolidone having a temperature of 60 to 90° C. and a concentration of 10 to 25%, preferably a temperature of 70 to 80° C. and a concentration of 15 to 20%.

Since the obtained undrawn yarn is not sufficiently oriented and crystallized at the above stage, it is drawn and heat-treated to effect the orientation and crystallization. The drawing temperature depends upon the polymer skeleton of the aromatic polyamide and is preferably 300 to 550° C. and the draw ratio is 8 or over, especially between 10 and 12.

EXAMPLES

The present invention is described in detail by the following Examples. The polymer solution (dope) used in the Examples was prepared by the following solution polymerization method, and the flatness of the fiber cross-section was measured by the following method.

Preparation of Dope

A mixing tank furnished with an anchor-type stirring blade was charged with 205 liter of N-methyl-2-pyrrolidone (hereinafter referred to as NMP) having a water content of about 20 ppm, and precisely weighed 2,764 g of p-phenylenediamine and 5,114 g of 3,4'-diaminodiphenyl ether were charged into the mixing tank and dissolved while flowing nitrogen gas in the tank. Precisely weighed 10,320 g of terephthaloyl chloride was charged into the diamine solution at 30° C. and a stirring speed of 64 rpm. When the temperature of the solution was raised to 53° C. by the heat of reaction, the solution was heated for 60 min to 85° C. The stirring was continued for 15 min at 85° C. and the polymerization reaction was assumed to be completed by the saturation of the viscosity increase of the solution.

The produced solution was charged with 16.8 kg of an NMP slurry containing 22.5% by weight of calcium hydroxide, stirred for 20 min to obtain a dope of pH 5.4 and filtered with a 20 micron mesh filter to prepare a polymer solution having a polymer concentration of 6% by weight (hereinafter called simply as dope).

Flatness

The cross-section of a fiber was photographed at a magnification ratio of 100, the diameters of perpendicularly crossing major axis (a) and minor axis (b) were measured from the photograph and the ratio (a/b) was calculated. The measurement was repeated 10 times and the average of the calculated ratios was used as the flatness.

Example 1

A bristle was produced by using the dope prepared by the above polymerization process. The spinning was carried out by a dry-jet spinning method using a spinneret having a single round nozzle of 0.6 mm diameter and 0.90 mm land length, extruding the dope at 110° C. and an extrusion rate of 7.9 g/min, coagulating in an aqueous solution having an NMP concentration of 20% by weight at 70° C., taking the spun fiber out of the bath at a spinning speed of 15 m/min, washing with water, drawing in two stages under heating at a draw ratio of 3.0 at 350° C. and then a draw ratio of 3.5 at 520° C. and winding at a speed of 200 m/min to obtain a bristle having a single fiber fineness of 20.2 denier. The bristle had the following physical properties.

Tensile strength: 23.0 g/de

Elongation at break: 3.0%

Initial modulus: 705 g/de

Flatness: 1.5

Example 2

The procedures of the Example 1 were repeated except for the change of the extrusion rate to 19.8 g/min to obtain a bristle having a singe fiber fineness of 50.1 denier. The physical properties of the bristle were as follows.

Tensile strength: 22.5 g/de

Elongation at break: 3.0%

Initial modulus: 710 g/de

Flatness: 1.8

Example 3

A bristle having a single fiber fineness of 100.8 denier was produced by a method similar to the Example 1 except for the use of a nozzle of 1.0 mm diameter and 1.5 mm land length and the change of the extrusion rate to 39.6 g/min and the NMP concentration of the aqueous solution to 10% by weight. The bristle had the following physical properties.

Tensile strength: 21.5 g/de

Elongation at break: 2.9%

Initial modulus: 695 g/de

Flatness: 1.9

Example 4

A bristle having a single fiber fineness of 180.3 denier was obtained by a method similar to the Example 3 except for the change of the extrusion rate to 71.3 g/min. The bristle had the following physical properties.

Tensile strength: 19.2 g/de

Elongation at break: 2.8%

Initial modulus: 690 g/de

Flatness: 2.1

Comparative Example 1

A bristle having a single fiber fineness of 45.0 denier was produced by a method similar to the Example 1 except for the use of a spinneret having a nozzle form obtained by connecting four circles of 0.18 mm diameter with linear slits of 0.08 mm wide and 0.3 mm long and the change of the extrusion rate to 24 g/min, the spinning speed to 30 m/min and the draw ratio to 9.8. The characteristics of the bristle are shown below. The rigidity was insufficient and the bristle was pliable because of large flatness.

Tensile strength: 18.5 g/de

Elongation at break: 3.50%

Initial modulus: 610 g/de

Flatness: 4.6

Example 5

Chemical resistances to acid and alkali were measured on the bristles of the Examples 1 to 4 and the Comparative Example 1. The result was shown in the Table 1. The acid resistance was represented by the tenacity retention ratio after the immersion in 20% aqueous solution of sulfuric acid at 95° C. for 100 hours and the alkali resistance was shown by the tenacity retention ratio after the immersion in 10% aqueous solution of sodium hydroxide at 95° C. for 100 hours.

TABLE 1

| | Tenacity Retention Ratio (%) | |
|---|---|---|
| | Acid Resistance | Alkali Resistance |
| Example 1 | 96 | 94 |
| Example 2 | 95 | 95 |
| Example 3 | 95 | 94 |
| Example 4 | 95 | 93 |
| Comparative Example 1 | 98 | 95 |

INDUSTRIAL APPLICABILITY

Since the aromatic polyamide bristle of the present invention is produced by the wet spinning and drawing of an isotropic dope, it has excellent mechanical properties such as high rigidity, strength and modulus and excellent chemical resistance characterized by remarkably improved durability to acid and alkali compared with conventional aromatic polyamide bristle. Accordingly, the bristle can be used widely in the field required to have the above characteristics such as a tension member, a fishing line and a catheter.

We claim:

1. An aromatic polyamide bristle formed from a copoly-p-phenylene 3,4-oxydiphenylene terephthalamide having a single fiber fineness of 10 to 200 denier, a flatness of 3 or less and mechanical characteristics satisfying the following conditions:

(1) Tensile strength of 15 g/de or more;

(2) Breaking elongation of 2.5% or more but less than 3.5%; and (3) Initial modulus of 500 g/de or more.

2. The aromatic polyamide bristle according to claim 1, which has a flatness of 1.5 or less.

* * * * *